US006143965A

United States Patent [19]

Chand

[11] Patent Number: 6,143,965

[45] Date of Patent: Nov. 7, 2000

[54] STRINGED MUSICAL INSTRUMENT

[76] Inventor: Baljinder Chand, 25461 La Habra Ct., Laguna Hills, Calif. 92653

[21] Appl. No.: 09/511,509

[22] Filed: Feb. 23, 2000

[51] Int. Cl.[7] ..... G10D 3/00

[52] U.S. Cl. ..... 84/290; 84/325; 84/282; 84/283

[58] Field of Search ..... 84/325, 282, 283, 84/290, 291, 292, 173; D17/19, 20, 99

[56] References Cited

U.S. PATENT DOCUMENTS

| | | | |
|---|---|---|---|
| 2,493,812 | 1/1950 | Graydon | 84/274 |
| 2,837,953 | 6/1958 | Baschet | 84/275 |
| 5,396,822 | 3/1995 | Itokawa | 84/291 |
| 5,918,297 | 6/1999 | Pliassov | 84/282 |

*Primary Examiner*—David Martin
*Assistant Examiner*—Kim Lockett
*Attorney, Agent, or Firm*—Goldstein & Canino

[57] ABSTRACT

A stringed musical instrument including a bowl portion having an open upper end and a closed lower end. The bowl portion has a pair of diametrically opposed openings therein downwardly of the open upper end. The open upper end has a cover secured thereto. An elongated rod extends through the pair of diametrically opposed openings of the bowl portion. The elongated rod has opposed ends disposed outwardly with respect to the bowl portion. A first opposed end is disposed in proximity to the bowl portion. A second opposed end is disposed remotely with respect to the bowl portion. A bridge is secured to the cover of the bowl portion. A length of steel wire is provided having a first end secured to the first opposed end of the elongated rod. The length of wire has a second end extending over the bridge for coupling with respect to the second opposed end of the elongated rod.

4 Claims, 1 Drawing Sheet

STRINGED MUSICAL INSTRUMENT

BACKGROUND OF THE INVENTION

The present invention relates to a stringed musical instrument and more particularly pertains to producing musical sounds for entertainment.

The use of musical instruments are known in the prior art. More specifically, musical instruments heretofore devised and utilized for the purpose of creating music are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,305,322 to Ray, Sr. discloses a stringed musical instrument comprised of strings stretched along a curved bow. U.S. Pat. No. 4,235,145 to Adams, Jr. and U.S. Pat. No. 5,355,757 to Plummer each disclose additional stringed instruments.

While these devices fulfill their respective, particular objective and requirements, the aforementioned patents do not describe a stringed musical instrument for producing musical sounds for entertainment.

In this respect, the stringed musical instrument according to the present invention substantially departs from the conventional concepts and designs of the prior art, and in doing so provides an apparatus primarily developed for the purpose of producing musical sounds for entertainment.

Therefore, it can be appreciated that there exists a continuing need for a new and improved stringed musical instrument which can be used for producing musical sounds for entertainment. In this regard, the present invention substantially fulfills this need.

SUMMARY OF THE INVENTION

In the view of the foregoing disadvantages inherent in the known types of musical instruments now present in the prior art, the present invention provides an improved stringed musical instrument. As such, the general purpose of the present invention, which will be described subsequently in greater detail, is to provide a new and improved stringed musical instrument which has all the advantages of the prior art and none of the disadvantages.

To attain this, the present invention essentially comprises a bowl portion having an open upper end and a closed lower end. The bowl portion has a pair of diametrically opposed openings therein downwardly of the open upper end. The open upper end has a paper cover secured thereto. An elongated rod extends through the pair of diametrically opposed openings of the bowl portion. The elongated rod has opposed ends disposed outwardly with respect to the bowl portion. A first opposed end is disposed in proximity to the bowl portion. A second opposed end is disposed remotely with respect to the bowl portion. A bridge is secured to the paper cover of the bowl portion. A length of steel wire is provided having a first end secured to the first opposed end of the elongated rod. The length of wire has a second end extending over the bridge for coupling with respect to the second opposed end of the elongated rod. A tension rod is secured to the opposed second end of the elongated rod. The tension rod is coupled with the second end of the length of steel wire. A bow portion is provided and is comprised of a curved bamboo portion having opposed ends. The bow portion includes a length of string that extends between the opposed ends of the curved bamboo portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved stringed musical instrument which has all the advantages of the prior art musical instruments and none of the disadvantages.

It is another object of the present invention to provide a new and improved stringed musical instrument which may be easily and efficiently manufactured and marketed.

It is a further object of the present invention to provide a new and improved stringed musical instrument which is of durable and reliable construction.

An even further object of the present invention is to provide a new and improved stringed musical instrument which is susceptible of a low cost of manufacture with regard to both materials and labor, and which accordingly is then susceptible of low prices of sale to the consuming public, thereby making such a stringed musical instrument economically available to the buying public.

Even still another object of the present invention is to provide a new and improved stringed musical instrument for producing musical sounds for entertainment.

Lastly, it is an object of the present invention to provide a new and improved stringed musical instrument including a bowl portion having an open upper end and a closed lower end. The bowl portion has a pair of diametrically opposed openings therein downwardly of the open upper end. The open upper end has a cover secured thereto. An elongated rod extends through the pair of diametrically opposed openings of the bowl portion. The elongated rod has opposed ends disposed outwardly with respect to the bowl portion. A first opposed end is disposed in proximity to the bowl portion. A second opposed end is disposed remotely with respect to the bowl portion. A bridge is secured to the cover of the bowl portion. A length of steel wire is provided having a first end secured to the first opposed end of the elongated rod. The length of wire has a second end extending over the bridge for coupling with respect to the second opposed end of the elongated rod.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
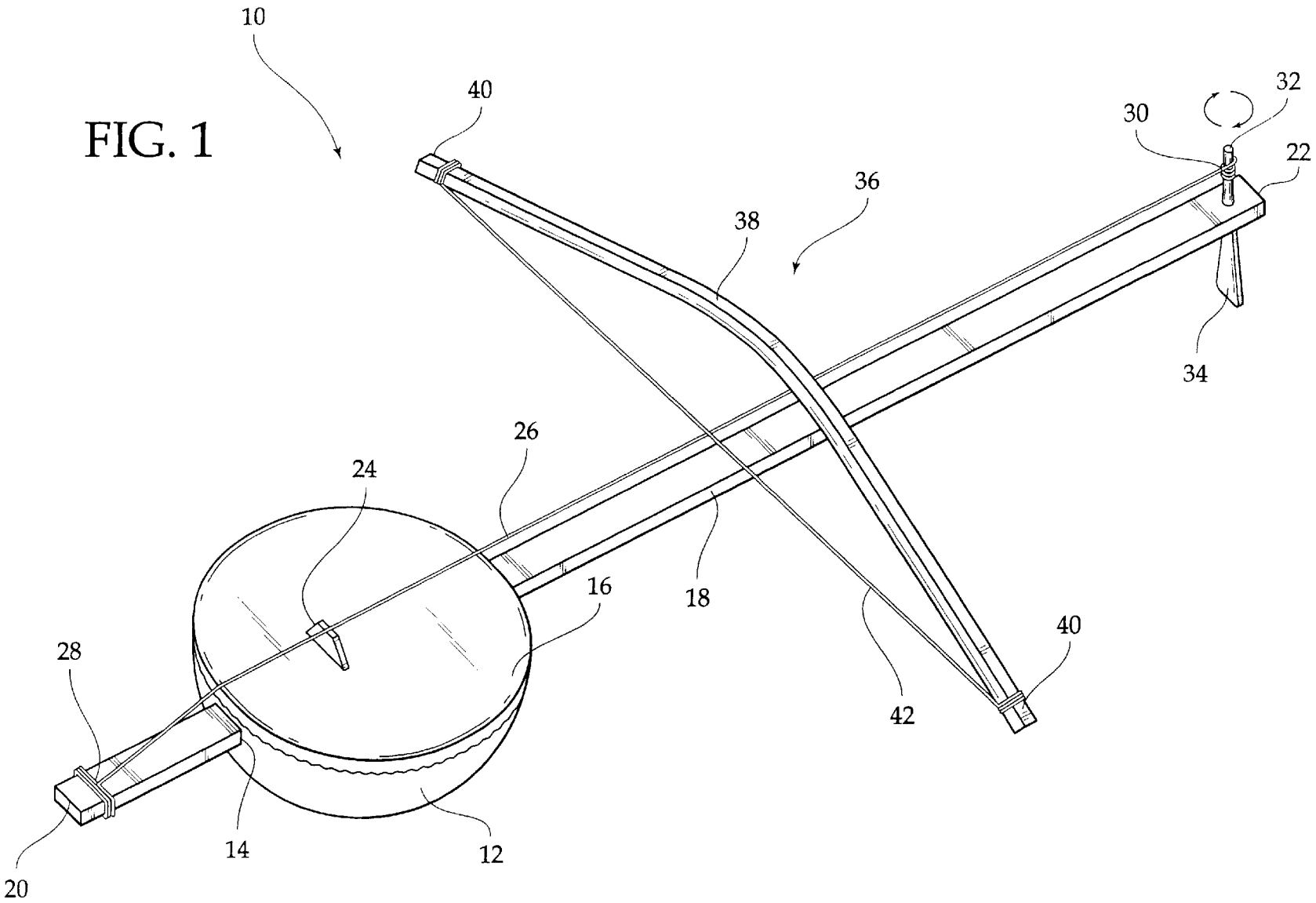
FIG. 1 is a perspective view of the preferred embodiment of the stringed musical instrument constructed in accordance with the principles of the present invention.

With reference now to the drawings, and in particular, to FIG. 1 thereof, the preferred embodiment of the new and improved stringed musical instrument embodying the principles and concepts of the present invention and generally designated by the reference number 10 will be described.

Specifically, it will be noted in the various Figures that the device relates to a stringed musical instrument for producing musical sounds for entertainment. In its broadest context, the device consists of a bowl portion, an elongated rod, a bridge, a length of steel wire, a tension rod, and a bow portion. Such components are individually configured and correlated with respect to each other so as to attain the desired objective.

The bowl portion 12, preferably constructed of clay, has an open upper end and a closed lower end. The bowl portion 12 has a pair of diametrically opposed openings 14 therein downwardly of the open upper end. The open upper end has a paper cover 16 secured thereto. Alternately, a plastic cover could be utilized.

The elongated rod 18 extends through the pair of diametrically opposed openings 14 of the bowl portion 12. The elongated rod 18 has opposed ends disposed outwardly with respect to the bowl portion 12. A first opposed end 20 is disposed in proximity to the bowl portion 12. A second opposed end 22 is disposed remotely with respect to the bowl portion 12.

The bridge 24 is secured to the paper cover 16 of the bowl portion 12. The bridge 24 is constructed of either wood or plastic and has a generally trapezoidal configuration with a wider end positioned on the paper cover 16.

The length of steel wire 26 has a first end 28 secured to the first opposed end 20 of the elongated rod 18. The length of wire 26 has a second end 30 extending over the bridge 24 for coupling with respect to the second opposed end 22 of the elongated rod 18.

The tension rod 32 is secured to the opposed second end 22 of the elongated rod 18. The tension rod 32 is coupled with the second end 30 of the length of steel wire 26. The tension rod 32 includes a handle portion 34 that will allow for the rotation of the tension rod 32 whereby the steel wire 26 will either tighten or loosen according to the desires of the user.

The bow portion 36 is comprised of a curved bamboo portion 38 having opposed ends 40. The bow portion 36 includes a length of string 42 that extends between the opposed ends 40 of the curved bamboo portion 48. The bow portion 36 is used by pulling it across the length of steel wire 26 at different angles and at different locations along its length to produce a variety of sounds.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A stringed musical instrument for producing musical sounds for entertainment comprising, in combination:

a bowl portion having an open upper end and a closed lower end, the bowl portion having a pair of diametrically opposed openings therein downwardly of the open upper end, the open upper end having a paper cover secured thereto;

an elongated rod extending through the pair of diametrically opposed openings of the bowl portion, the elongated rod having opposed ends disposed outwardly with respect to the bowl portion, a first opposed end being disposed in proximity to the bowl portion, a second opposed end being disposed remotely with respect to the bowl portion;

a bridge secured to the paper cover of the bowl portion;

a length of steel wire having a first end secured to the first opposed end of the elongated rod, the length of wire having a second end extending over the bridge for coupling with respect to the second opposed end of the elongated rod;

a tension rod secured to the opposed second end of the elongated rod, the tension rod being coupled with the second end of the length of steel wire;

a bow portion comprised of a curved bamboo portion having opposed ends, the bow portion including a length of string that extends between the opposed ends of the curved bamboo portion.

2. A stringed musical instrument for producing musical sounds for entertainment comprising, in combination:

a bowl portion having an open upper end and a closed lower end, the bowl portion having a pair of diametrically opposed openings therein downwardly of the open upper end, the open upper end having a cover secured thereto;

an elongated rod extending through the pair of diametrically opposed openings of the bowl portion, the elongated rod having opposed ends disposed outwardly with respect to the bowl portion, a first opposed end being disposed in proximity to the bowl portion, a second opposed end being disposed remotely with respect to the bowl portion;

a bridge secured to the cover of the bowl portion;

a length of steel wire having a first end secured to the first opposed end of the elongated rod, the length of wire having a second end extending over the bridge for coupling with respect to the second opposed end of the elongated rod.

3. The stringed musical instrument as set forth in claim 2 and further including a tension rod secured to the opposed second end of the elongated rod, the tension rod being coupled with the second end of the length of steel wire.

4. The stringed musical instrument as set forth in claim 2 and further including a bow portion comprised of a curved bamboo portion having opposed ends, the bow portion including a length of string that extends between the opposed ends of the curved bamboo portion.

* * * * *